US010612847B2

(12) United States Patent
Ayrault et al.

(10) Patent No.: US 10,612,847 B2
(45) Date of Patent: Apr. 7, 2020

(54) DRUM DRYER

(71) Applicant: ANDRITZ PERFOJET SAS, Montbonnot (FR)

(72) Inventors: Xavier Ayrault, Allevard les Bains (FR); Frédéric Noelle, Saint-Nazaire les Eymes (FR)

(73) Assignee: ANDRITZ PERFOJET SAS, Montbonnot (FR)

( * ) Notice: Subject to any disclaimer, the term of this patent is extended or adjusted under 35 U.S.C. 154(b) by 138 days.

(21) Appl. No.: 15/558,604

(22) PCT Filed: Mar. 16, 2016

(86) PCT No.: PCT/EP2016/055645
§ 371 (c)(1),
(2) Date: Sep. 15, 2017

(87) PCT Pub. No.: WO2016/146662
PCT Pub. Date: Sep. 22, 2016

(65) Prior Publication Data

US 2018/0080712 A1 Mar. 22, 2018

(30) Foreign Application Priority Data

Mar. 17, 2015 (FR) ..... 15 00524

(51) Int. Cl.

| | |
|---|---|
| ***F26B 13/16*** | (2006.01) |
| ***D21F 5/18*** | (2006.01) |
| ***D06B 15/04*** | (2006.01) |
| ***D06B 23/02*** | (2006.01) |
| ***F26B 3/06*** | (2006.01) |

(52) U.S. Cl.
CPC ..... *F26B 13/16* (2013.01); *D06B 15/043* (2013.01); *D06B 23/025* (2013.01); *D21F 5/184* (2013.01); *F26B 3/06* (2013.01)

(58) Field of Classification Search
CPC ..... F26B 13/16; F26B 3/06; D06B 15/043; D06B 23/025; D21F 5/184
See application file for complete search history.

(56) References Cited

U.S. PATENT DOCUMENTS

| | | | | |
|---|---|---|---|---|
| 3,510,955 | A | 5/1970 | Fleissner | |
| 4,542,596 | A | 9/1985 | Bryand | |
| 5,128,028 | A | 7/1992 | Lamort | |
| 5,575,080 | A | 11/1996 | Fleissner | |
| 7,040,038 | B1 | 5/2006 | Beaumont | |
| 2006/0021151 | A1* | 2/2006 | Fleissner | D06B 23/025 8/148 |
| 2014/0215848 | A1 | 8/2014 | Böhn | |

FOREIGN PATENT DOCUMENTS

| | | |
|---|---|---|
| DE | 42 39 640 A1 | 7/1993 |
| DE | 100 01 535 A1 | 7/2001 |
| GB | 1 151 709 | 5/1969 |

* cited by examiner

*Primary Examiner* — Jessica Yuen
(74) *Attorney, Agent, or Firm* — Renner Kenner Greive Bobak Taylor & Weber

(57) ABSTRACT

Metal drum dryer, the side surface of which is constituted of U-shaped profiles (1), each having a bottom, each profile (1) is welded to the two neighbouring profiles (1) thereof and the bottom of each profile (1) is pierced with holes (4).

14 Claims, 6 Drawing Sheets

DRUM DRYER

The present invention relates to dryers intended for drying with hot gas, in particular hot air, a cloth such as a non-woven fabric that has been consolidated by jets of water or some other textile or paper moist cloth.

The metal drums used in this type of dryer are mounted rotatably within a hood or a housing in which hot air arriving via the outside of the drum passes into holes in the drum by crossing the cloth to be dried passing over the drum. And the hot air is continuously sucked in via the inside of the drum by one or more fans.

The metal drums used in dryers must have a large open surface level with the cloth to be dried for the passage of large amounts of air and good structural rigidity so as to enable the construction of drums with large widths and large diameters.

They are generally formed by a metal structure, possibly covered with at least one layer of a metal fabric with small (or fine) openings in contact with the cloth to be dried.

If the metal structure of the drum does not provide sufficient support for the fine metal fabric, they are then covered with a first layer of a course metal fabric and with a second layer of a metal fabric that is finer than the first and is in contact with the non-woven fabrics or the cloths to be dried.

The fabric or fabrics is or are mounted in the form of taut sleeves and are fixed to each of the ends of the drum on its side surfaces or on the edges of its circumference.

The purpose of these fabrics is to finely diffuse the air level with the cloths to be dried and not to mark them or deform them with their fine structure, far finer that that of the metal drum lying beneath.

It has been proposed to construct these drums from a rolled perforated metal sheet. This is a very economical technique. But this construction technique is not very successful because on the one hand the open surface of the perforated metal sheets is generally less than 50% or even less than 40%, and this is detrimental to good drying efficiency and on the other hand the suction is not uniform due to the large metal bridges between the perforations of the metal sheets.

It has also been proposed in EP 1 563 134 to construct these drums with metal sheets crossing on their edge and interlinked at their intersection. This technical solution overcomes the disadvantage of the small open surface of the perforated metal sheets by means of a very large open surface. But these drums have poor rigidity and bend with a large width, i.e. widths greater than 3.5 m. They may deform and twist if there are emergency halts in production.

On the other hand, known from U.S. Pat. No. 5,128,028A is a metal drum that has a side surface pierced with holes and formed from U-shaped profiles that each have a bottom and two branches passing radially towards the outside of the drum. Each profile is fixed to its two neighbouring profiles by its branches. This drum is used in the paper pulp industry in filter sieves for sieving and for separating fibres and is easier to produce than the earlier drums.

However, we have found, and this is what is the object of the present invention, a dryer that overcomes the disadvantages of the prior art, the drum of which has both a large open surface that provides good uniformity of the passage of hot air, and so homogeneous drying, a rigidity very much greater than that of the prior art solutions making it possible to produce drums and ovens which are more than 4 metres wide, and at an economical construction cost, less expensive than the solution of EP 1 563 134, making it possible to simplify the dryer and to regulate the drying, while having just one housing.

The object of the invention is a dryer that comprises a housing that has a hot air inlet, a metal drum mounted rotatably about its axis within the housing, a metal gauze stretched around the side surface of the drum and rotationally fixed, and means for passing a cloth to be dried over the gauze, characterised in that the side surface of the drum is formed from U-shaped profiles that each have a bottom pierced with holes and two branches passing radially towards the outside of the drum, each profile being fixed to its two neighbouring profiles by its branches.

The drum is more rigid than the drums used until now, even though it has a large length, as is appropriate for drying wide cloths. Since the holes in the bottom of the profile are a long way from the gauze, the throughput of air is very uniform within the gauze. The drying of the cloth is uniform.

In order to have good drying, it is desirable for the average opening percentage of the gauze to be between 25 and 75% and that of the bottom of each profile to be between 10 and 70%, preferably between 15 and 60%. The opening percentage is defined by dividing the surface of the holes by the total surface of the bottom. When one considers a part of the bottom, this opening percentage of a part of the bottom is the result of dividing the surface of the holes of this part of the bottom by the total surface of this part of the bottom. Preferably, the distance between two neighbouring holes represents 1.5 times to 5 times the largest dimension of the holes.

In one embodiment, the drum is mounted rotatably about a fixed housing that has perforations that give opening percentages that increase from the side to which the fan is connected for sucking air into the inside of the drum. The purpose of this housing is to distribute the air suction uniformly over the width of the drum. The U-shaped profiles of the drum have in this case a perforation with a constant opening percentage and the greatest possible percentage over the width of the drum.

It is then better for the holes to be rectangular, with their large sides parallel to the longitudinal direction of the profiles.

The largest dimension of the holes is preferably between 40 and 150 mm. The width of the bottom is preferably between 70 and 120 mm. The gauze preferably has openings of which the dimensions range from 0.5 to 3 mm.

In another embodiment which is preferred because it is even less expensive, there is no fixed housing for distributing suction within the drum. In this case one can even better guarantee the uniformity of the drying of a wide cloth if one provides an increase in the opening percentage of the bottom of each profile from one front side to the other of the drum. This increase in the opening percentage may be made continuously or incrementally. If one mentally subdivides the drum into ten parts along its length, the opening percentage of the bottom, from the front side that is the closest to the suction of hot air into the inside of the drum, is lower than the opening percentage of the following part of the bottom, and so on up to the part of the bottom located on the other front side. Preferably, the rate of increasing the opening percentage is between 3 and 6 times the smallest opening percentage of the side closest to the suction. The essential thing is to compensate, by means of a larger opening percentage, the lower throughput of the suction of hot air from one side to the other of the drum in order to obtain uniform distribution of the air speeds through the cloth to be dried over the whole width of the drum.

For large widths it may be advantageous to suck in air via both ends of the drum rather than via just one. In this case the opening percentage increases, preferably symmetrically, from each edge towards the centre of the drum, and is at its maximum at the centre of the drum.

In order to further improve the open surface of the drum level with the metal gauze of the outer covering, at least one of the branches of each profile is shorter than the other so that the metal gauze is only rested on the edge of just one branch for two successive U-shaped profiles. Just one of the two branches touches the gauze. This device greatly favours uniformity of the high throughput of hot air close to the gauze because the surface of the permeable gauze is thus burdened as little as possible. The length of the largest branch is preferably 1.5 to 3 times greater than that of the smallest branch of the U.

In order to further improve the rigidity and the cylindrical form of the drum, at least one of the branches of each profile, and in particular just one of them or possibly each of them, has a notch into which a hoop which strengthens the drum and makes it more rigid penetrates. For a drum with a diameter from one bottom to the diametrically opposed bottom of between 1,400 and 3,000 mm, one may advantageously provide a hoop every 300 to 600 mm.

In one decisive improvement of the dryer according to the invention, a plug for the holes is slidably mounted on the bottom of each U-shaped profile such as to clear or at least partially plug the holes. Preferably, the plug is mounted on the inner surface of the U. One can thus dispense with an additional housing for mounting the plugs. The dryer may have just one housing.

The invention also relates to the use of several drums in one and the same dryer. In this case the drums are generally arranged horizontally in one or more successive housings with, preferably according to the invention, just one housing per drum.

In the attached drawings, given purely by way of example:

Figure 1:
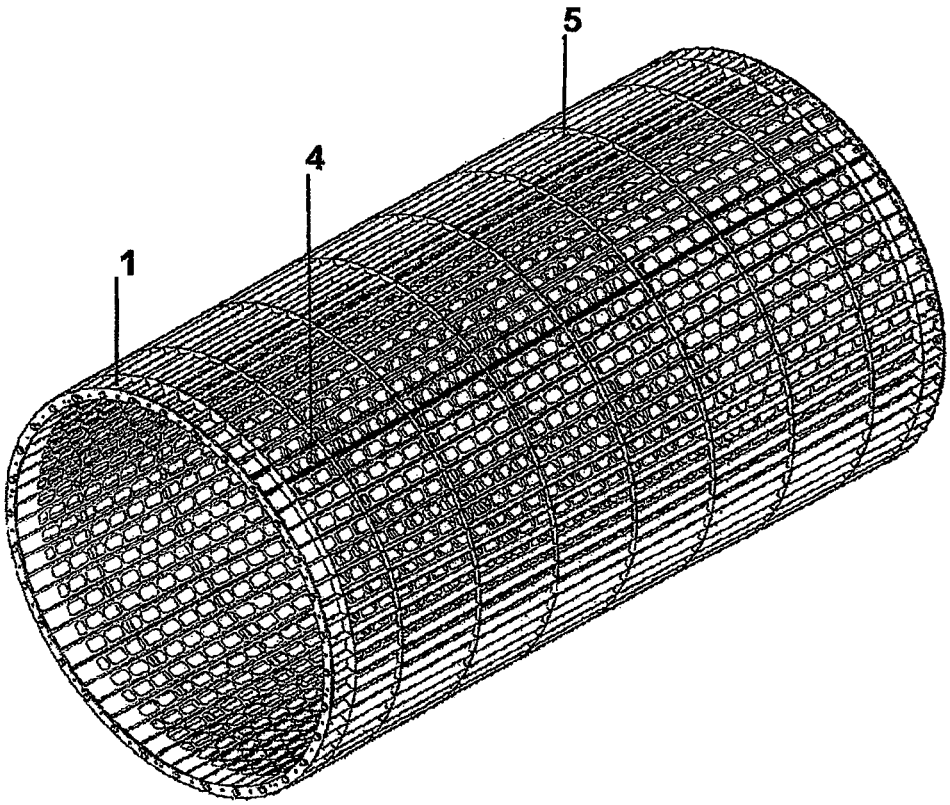
FIG. 1 is a perspective view of a drum used in the dryer according to the invention.
Figure 2:
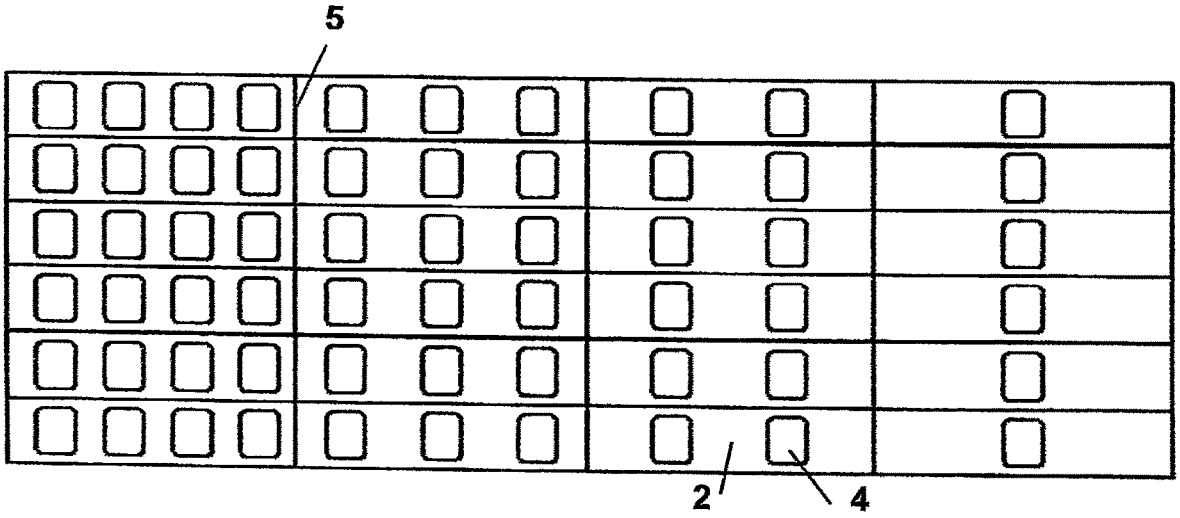
FIG. 2 is a more detailed view of part of the side surface of a drum used in the dryer according to the invention.
Figure 4:
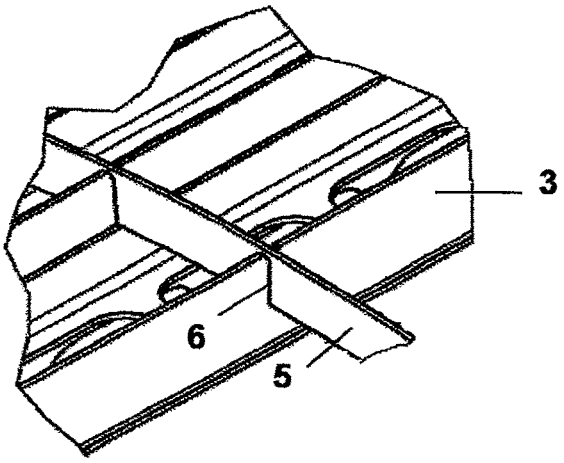
FIG. 4 is a detailed view of the drum of FIG. 1.

The steel drum shown in FIG. 1 comprises a plurality of U-shaped profiles or side members 1. As shown in FIG. 2, each one has a bottom 2 pierced with holes 4 and two branches 3 passing radially from the bottom 2 towards the outside of the drum. Each profile 1 is welded to its two neighbouring profiles by their branches 3 such as to form a continuous drum. The drum of FIG. 1 comprises seven hoops 5 distributed uniformly over the length of the drum and pushed down into notches 6 made in the branches 3 (see FIG. 4). As shown by FIG. 2, the number of holes 4 in the bottom increases from one front side to the other of the drum. Between the end of the drum located on the left, in FIG. 2, and the first hoop 5 there are, via the side member 1, four rectangular holes 4, whereas between the first and the second hoop, the bottoms have three holes 4, the number of holes 4 decreasing towards the right. Instead of or at the same time as increasing the number of holes, one may also increase the dimensions.

Figure 3:
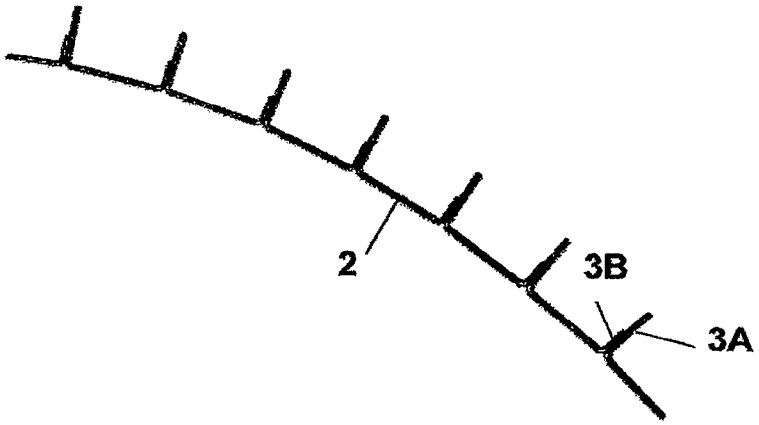
FIG. 3 is a partial view sectioned transversely to the axis of the drum of FIG. 1.

FIG. 3 shows the branches 3A and 3B of each side member 1 which are of unequal length, the shortest branch of a side member being welded to the longest branch of the neighbouring side member 1.

Figure 5:
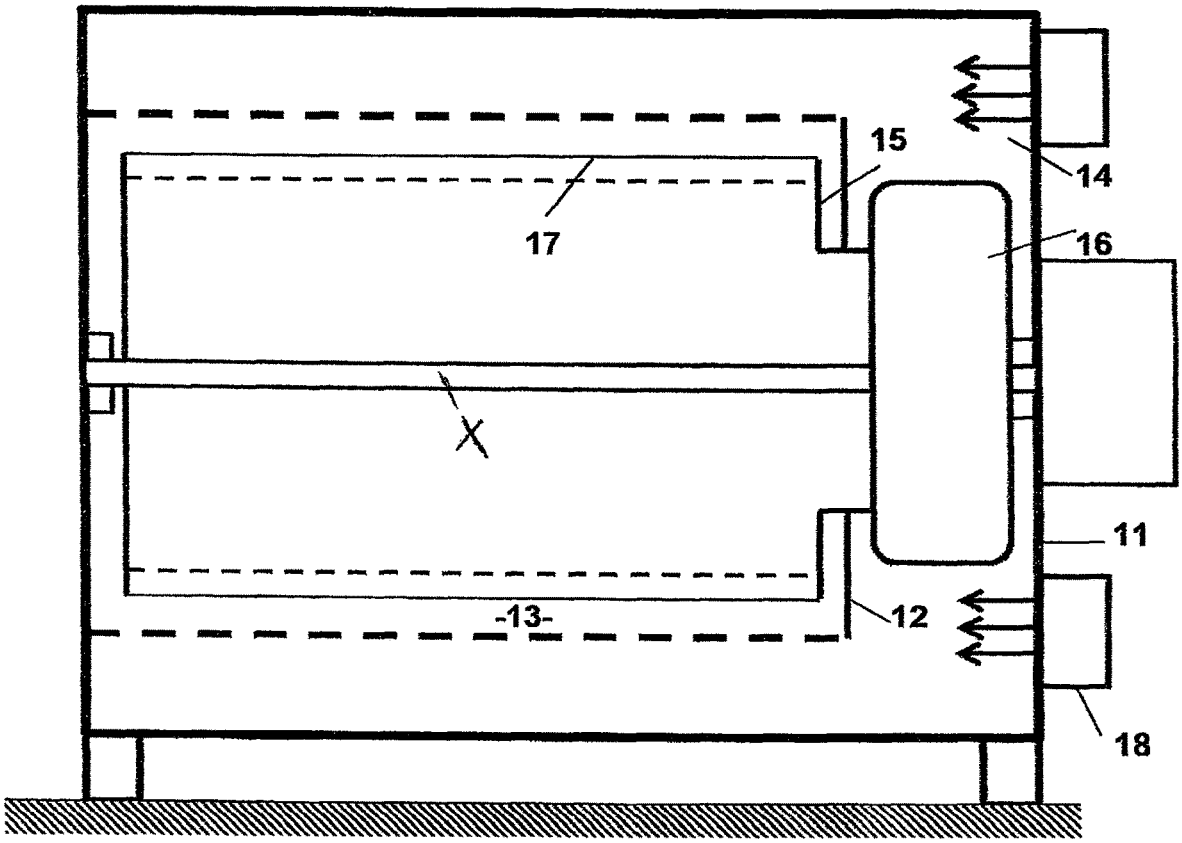
FIG. 5 is a sectional view of a dryer according to the invention.

The dryer shown in FIG. 5 comprises a housing 11 subdivided by a partition 12 into one compartment 13 for processing and one compartment 14 for circulating air. A drum 15 is mounted rotatably about its axis X, being driven by a drive that is not shown in the compartment 13, and a fan 16 is mounted in the compartment 14. The fan sends air into the drum 15 and sends it back into the compartment 14, then 13. The textile cloth to be processed rests on a fine gauze 17 stretched around the side surface of the drum 15 and fixed by its edges to the latter. The air of the compartment 13 is reheated by one or more burners 18 in the case of using gas, or by exchangers in the case of using other energy sources such as steam or fuel oil.

Figure 6:
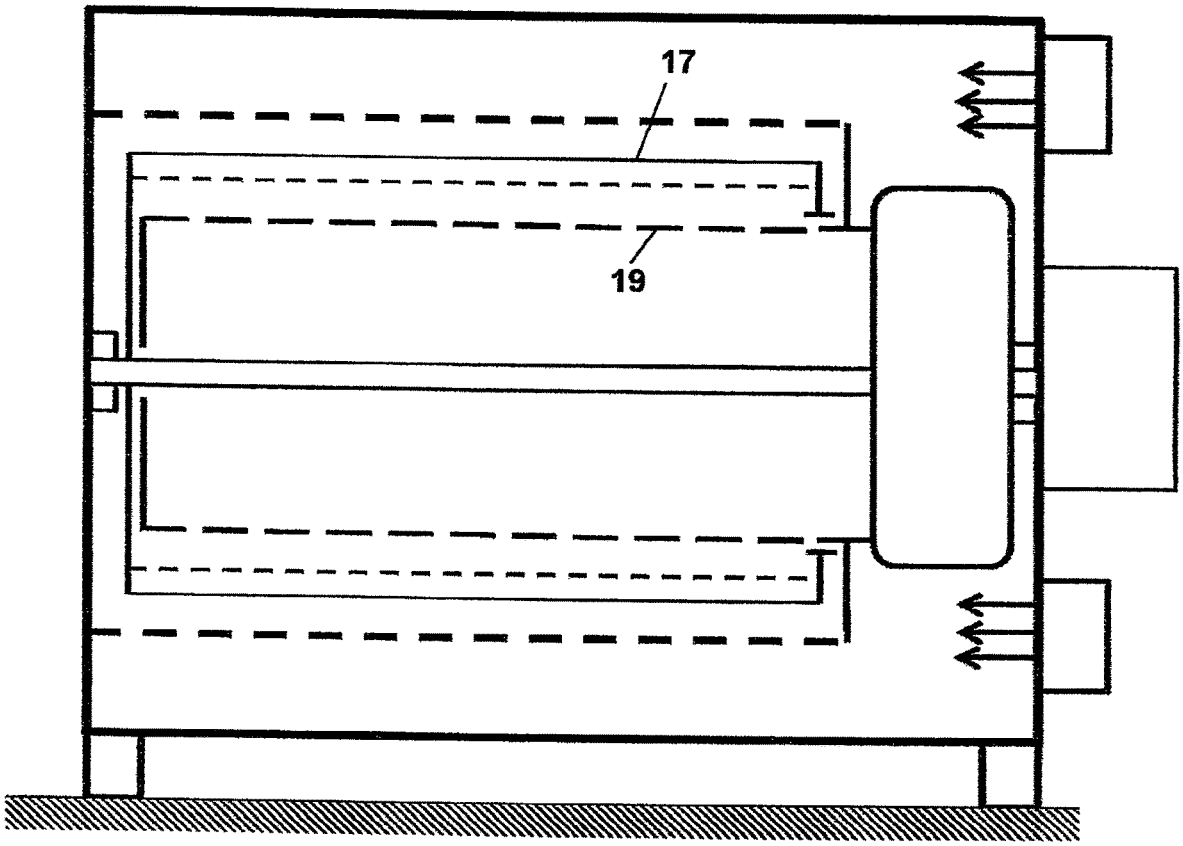
FIG. 6 is a sectional view of a version of the dryer.

The dryer of FIG. 6 differs from that of FIG. 5 by the presence of a fixed internal housing 19 that makes it possible, by means of flaps, to regulate the throughput of air over the length of the dryer.

Figure 7:
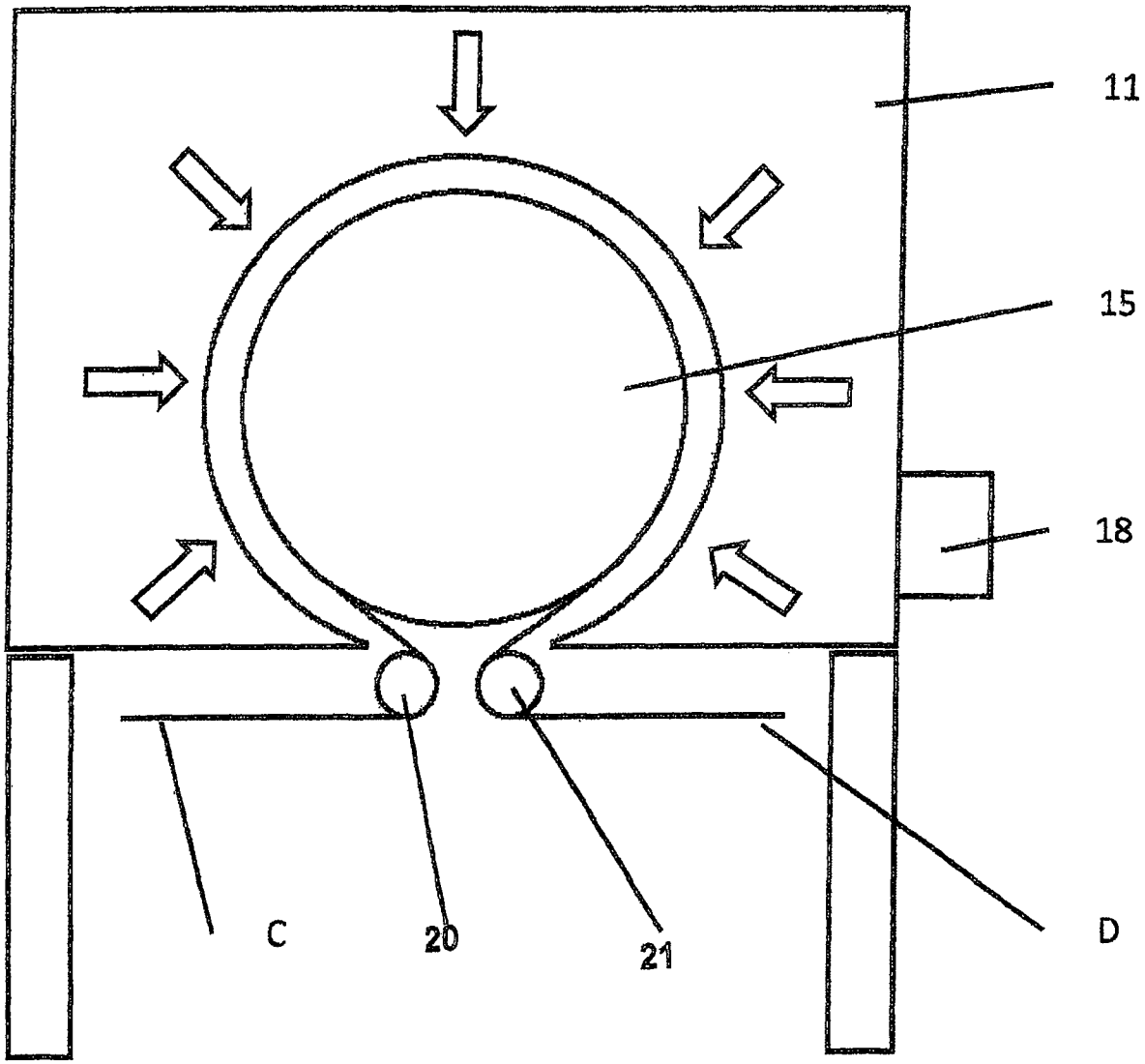
FIG. 7 is a sectional view along a vertical plane of a dryer according to the invention.

FIG. 7 shows a preferred dryer according to the invention. The dryer comprises a drum 15 mounted rotatably within a single housing 11 for the circulation of hot air.

The moist non-woven fabric to be dried C enters into the dryer via a turning roll 20. It rests on the surface of a gauze stretched over the rotating drum 15 when it passes through the inside of the housing 11. The housing 11 diffuses hot air over the non-woven fabric. This air is heated by a burner 18 or some other heating device such as exchangers. The hot air passes through the non-woven fabric to be dried and is sucked into the inside of the drum 15 by means which are not shown. The dried non-woven fabric D is evacuated from the dryer by a new turning roll 21. The hot air that has passed through the non-woven fabric and that has been sucked into the inside of the drum is then reheated by a burner or an exchanger 18 considered to be the air inlet of the housing, and is then redirected by a fan (not shown) towards the surface of the drum covered with gauze and covered with the non-woven fabric to be dried.

Figure 8:
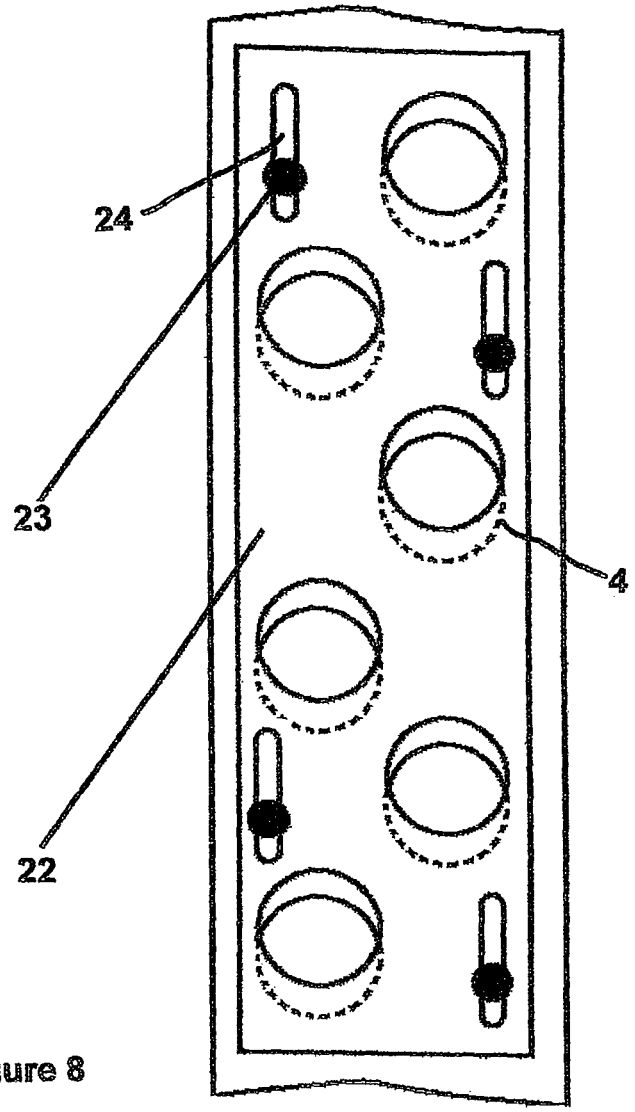
FIG. 8 is a more detailed plan view of the bottom of a U-shaped profile of a drum used in the dryer according to the invention.

FIG. 8 shows a U-shaped profile that has circular holes on the bottom. A plug 22 pierced with holes with the same dimensions and the same positioning as the holes in the bottom of the U-shaped profile slides via inserts 23 into oblong holes 24 on the internal surface of the U-shaped profile (on the outside of the drum) such as to partially plug the holes in the bottom of the U. Each U may have a number of plugs side by side such as to obtain an opening or a plug that can be varied over the whole length of each U and so over the whole suction width of the drum.

Figure 9:
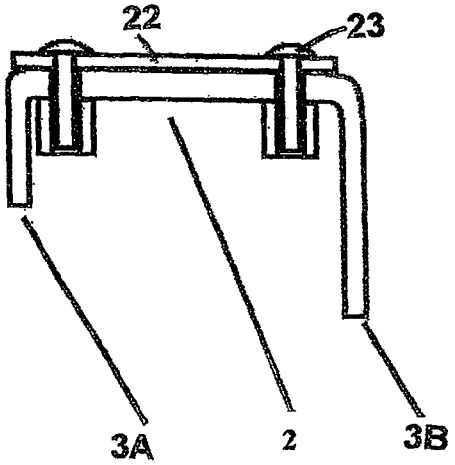
FIG. 9 is a side view.

FIG. 9 shows a sectional view of a U-shaped profile 2 to which a plug 22 is fixed by screws and nuts or via RIVKLE WWW-type inserts (rivets).

The invention claimed is:

1. A dryer that comprises a housing (11) that has a hot air inlet (18), a metal drum (15) mounted rotatably about its axis (X) within the housing (11), a metal gauze (17) stretched around the side surface of the drum (15) and rotationally fixed, and means (A, B) for passing a cloth (C) to be dried over the gauze (17), characterised in that the side surface of the drum (15) is formed from U-shaped profiles that each have a bottom (2) pierced with holes (4) and two branches (3) passing radially towards the outside of the drum (15), each profile being fixed to its two neighbouring profiles by its branches (3), and wherein at least one of the branches of each profile has a notch into which a hoop penetrates.

2. The dryer according to claim 1, characterised in that the gauze (17) has openings of which the dimensions range from 0.5 to 3 mm, and the drum (15) has holes (4), the largest dimension of each hole (4) being from 40 to 150 mm.

3. The dryer according to claim 2, characterised in that the holes (4) are rectangular.

4. The dryer according to claim 1, characterised in that the height of the branches (3) in the radial direction ranges from 30 to 150 mm.

5. The dryer according to claim 4, characterised in that an opening percentage of the gauze (17) ranges from 25 to 75%.

6. The dryer according to claim 5, characterised in that an opening percentage of the bottom of each profile ranges from 10 to 70%.

7. The dryer according to claim 6, characterised in that the distance between two neighbouring holes (4) represents from 1.5 to 5 times the largest dimension of the holes (4) wherein the largest dimension of the holes (4) is between 40 and 150 mm.

8. The dryer according to claim 1, characterised in that the one or more plugs (22) is mounted on the inner surface of the U of the bottom (2) of the U-shaped profile.

9. The dryer according to claim 1, characterised h an increase in an opening percentage of the bottom (2) of each U-shaped profile (1), wherein the opening percentage is defined by dividing a surface area defined by the holes by a total surface area of the bottom, wherein a side of the metal drum nearest the hot air inlet has a smallest opening percentage, wherein a rate of increase in the opening percentage from the side of the metal drum nearest the hot air inlet to an opposite side of the metal drum along the drum length is between 3 and 6 times the smallest opening percentage and wherein the opening percentage of the bottom (2) of each U-shaped profile (1) is between 1.0 and 70%.

10. The dryer according to claim 1, characterised in that it only comprises one housing (11).

11. A dryer that comprises a housing (11) that has a hot air inlet (18), a metal drum (15) mounted rotatably about its axis (X) within the housing (11), a metal gauze (17) stretched around the side surface of the drum (15) and rotationally fixed, and means (A, B) for passing a cloth (C) to be dried over the gauze (17), characterised in that the side surface of the drum (15) is formed from U-shaped profiles that each have a bottom (2) pierced with holes and two branches (3) passing radially towards the outside of the drum (15), each profile being fixed to its two neighbouring profiles by its branches (3), and wherein one of the branches (3) of each profile is larger than the other branch (3) and the gauze (17) only rests on the largest branch (3) spaced apart from the smallest branch (3).

12. A dryer that comprises a housing (11) that has a hot air inlet (18), a metal drum (15) mounted rotatably about its axis (X) within the housing (11), a metal gauze (17) stretched around the side surface of the drum (15) and rotationally fixed, and means (A, B) for passing a cloth (C) to be dried over the gauze (17), characterised in that the side surface of the drum (15) is formed from U-shaped profiles that each have a bottom (2) pierced with holes and two branches (3) passing radially towards the outside of the drum (15), each profile being fixed to its two neighbouring profiles by its branches (3), characterised in that one or more plug(s) (22) for the holes (4) is slidably mounted on the bottom (2) of each U-shaped profile such as to clear or at least partially plug the holes (4).

13. A dryer that comprises a housing (11) that has a hot air inlet (18), a metal drum (15) mounted rotatably about its axis (X) within the housing (11), a metal gauze (17) stretched around the side surface of the drum (15) and rotationally fixed, and means (A, B) for passing a cloth (C) to be dried over the gauze (17), characterised in that the side surface of the drum (15) is formed from U-shaped profiles that each have a bottom (2) pierced with holes and two branches (3) passing radially towards the outside of the drum (15), each profile being fixed to its two neighbouring profiles by its branches (3), characterised by an increase in the opening percentage of the bottom (2) of each U-shaped profile (1), from each edge towards the centre of the drum.

14. The dryer according to claim 13, characterised in that an opening percentage of the bottom (2) of each U-shaped profile (1) is between 10 and 70%.

* * * * *